US007384345B2

(12) United States Patent
Sherman

(10) Patent No.: US 7,384,345 B2
(45) Date of Patent: Jun. 10, 2008

(54) GOLF PUTTER WITH ROTARY DISC ALIGNMENT AID

(76) Inventor: Robyn Ann Sherman, 5 Turana Street, Coombabah, Queensland 4216 (AU)

( * ) Notice: Subject to any disclaimer, the term of this patent is extended or adjusted under 35 U.S.C. 154(b) by 69 days.

(21) Appl. No.: 10/544,983

(22) PCT Filed: Feb. 12, 2004

(86) PCT No.: PCT/AU2004/000165

§ 371 (c)(1),
(2), (4) Date: Jan. 9, 2006

(87) PCT Pub. No.: WO2004/071594

PCT Pub. Date: Aug. 26, 2004

(65) Prior Publication Data

US 2006/0148584 A1 Jul. 6, 2006

(30) Foreign Application Priority Data

Feb. 12, 2003 (AU) ..... 2003900622

(51) Int. Cl.
*A63B 69/36* (2006.01)
*A63B 53/04* (2006.01)

(52) U.S. Cl. ..... 473/249; 473/340

(58) Field of Classification Search ..... 473/219–256, 473/340–341; D21/736–746
See application file for complete search history.

(56) References Cited

U.S. PATENT DOCUMENTS 2,517,245 A * 8/1950 Scott ..... 473/339
3,199,874 A * 8/1965 Blasing ..... 473/244
3,548,504 A * 12/1970 Sykes ..... 33/286
4,136,877 A 1/1979 Antonious
4,530,505 A * 7/1985 Stuff ..... 473/250
4,928,971 A 5/1990 Soles, Jr.
5,174,572 A 12/1992 Ho
5,219,169 A 6/1993 Martini
5,429,366 A 7/1995 McCabe
5,643,100 A 7/1997 Zabytko et al.
5,649,871 A 7/1997 Ryan
5,683,309 A * 11/1997 Reimers ..... 473/337
5,709,612 A 1/1998 Salado
5,916,042 A * 6/1999 Reimers ..... 473/334
6,241,624 B1 6/2001 Zabytko et al.
2006/0247071 A1* 11/2006 Wormersley ..... 473/340

FOREIGN PATENT DOCUMENTS

GB 2149670 A 6/1985

* cited by examiner

*Primary Examiner*—Sebastiano Passaniti
(74) *Attorney, Agent, or Firm*—Duane Morris LLP

(57) ABSTRACT

A putter head (1) is described wherein the putter head (1) has a putter face (4) and a linear marking (9) located on an upper surface (44) of the putter head (1). The relative angle of the putter face (4) with respect to the linear marking (9) is adjustable in order to compensate for inherent inaccuracies in a player's visual judgement when putting. In a preferred embodiment, the upper surface (44) is in the form of a rotatable disc (3) wherein the rotatable disc (3) is moveable about an axis in order to selectively adjust the relative angle between the linear marking (9) and the putter face (4).

1 Claim, 13 Drawing Sheets

GOLF PUTTER WITH ROTARY DISC ALIGNMENT AID

FIELD OF THE INVENTION

The invention relates to putter heads. In particular, although not exclusively, the invention relates to a putter head that provides for a more accurate putting stroke.

BACKGROUND TO THE INVENTION

The game of golf is one of the most popular recreational sports in the world in terms of participants. The popularity of golf does not mean that the game is easy. Golf requires consistent precision of movement to achieve mastery of the game. Subtle imperfections in the execution of strokes produce amplified errors in the outcome of the shot. In particular, many golfers have identified the putting stroke as the most difficult to master and the area in which most strokes are dropped during a round of golf.

It has been found that for longer distance putts a right handed player aims to the right of their intended target. Similarly, a left handed player aims to the left of their intended target. This is due to the fact that human vision has evolved to judge distance and path while the head is horizontal. However, when a golfer is lining up a putt, the head is held at an angle and hence the eyes are not horizontal. This physiological inaccuracy in judgement results in many putts being missed due to being aligned incorrectly.

OBJECT OF THE INVENTION

The object of the invention is to overcome or at least alleviate one or more of the above problems and/or provide the consumer with a useful or commercial choice.

DISCLOSURE OF THE INVENTION

In one form, although it need not be the only or indeed the broadest form, the invention resides in a putter head comprising:

a putter face; and a linear marking located on an upper surface of said putter head, said linear marking orientated at an angle to said putter face;

wherein, said angle is adjustable.

Preferably, said upper surface of said putter head is formed from a rotatable disc.

Optionally, said upper surface of said putter head is formed from a replaceable disc, said linear marking being located on said replaceable disc, said replaceable disc being removable from said putter head such that said replaceable disc may be replaced by one of a series of further replaceable discs, each said further replaceable disc having a linear marking located on a upper surface.

Alternatively, said putter face is mounted to said putter head by means of a hinge such that said putter face is moveable with respect to said linear marking by means of at least one adjustment screw.

In a further form, the invention resides in a method of correcting an error in a golf stroke including the steps of:

identifying an error in a puffing stroke; and adjusting an angle formed between a linear marking and a putter face, said linear marking being aligned parallel to a stroke path of a putter head.

In still a further form, the invention resides in a golf putter comprising:

a shaft;

a putter head mounted on a lower extent of said shaft, said putter head comprising a putter face;

a rotatable disc located on an upper surface of said putter head; and a linear marking located on said rotatable disc, said linear marking orientated at an angle to said putter face;

wherein, said rotatable disc is rotatable such that said angle is adjustable.

Further features of the present invention will become apparent from the following detailed description.

BRIEF DESCRIPTION OF THE DRAWINGS

To assist in understanding the invention and to enable a person skilled in the art to put the invention into practical effect preferred embodiments of the invention will be described by way of example only with reference to the accompanying drawings, wherein.

DETAILED DESCRIPTION OF THE INVENTION

Figure 1:
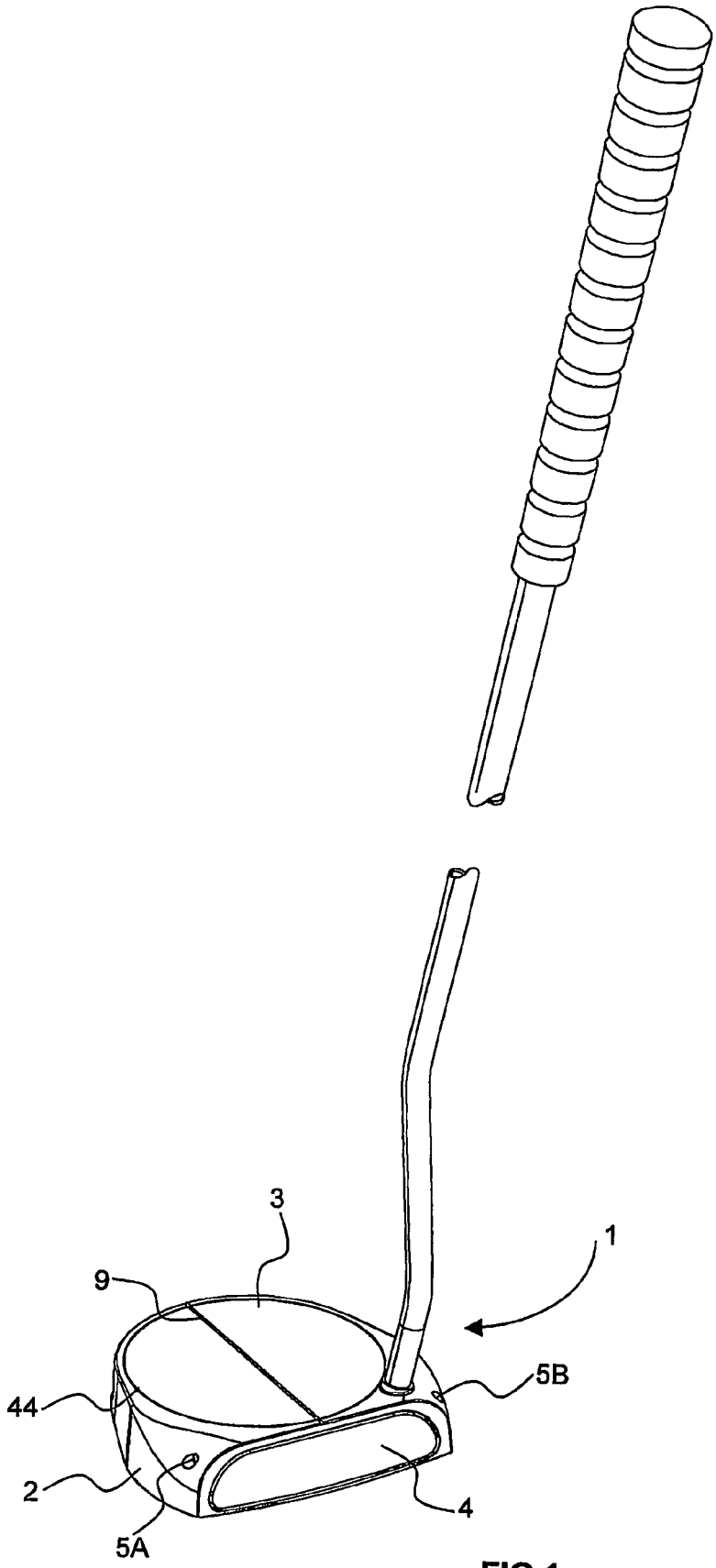
FIG. 1 shows a front perspective view of a putter head according to an embodiment of the present invention in a primary position.

FIG. 1 shows a putter head 1 according to a first embodiment of the present invention. Putter head 1 comprises a body 2, an upper surface 44 in the form of a rotatable disc 3, a putter face 4 and two threaded cavities 5A and 5B. Threaded cavities 5A and 5B are located within body 2 adjacent putter face 4. A linear marking 9 is located on rotatable disc 3.

Figure 2:
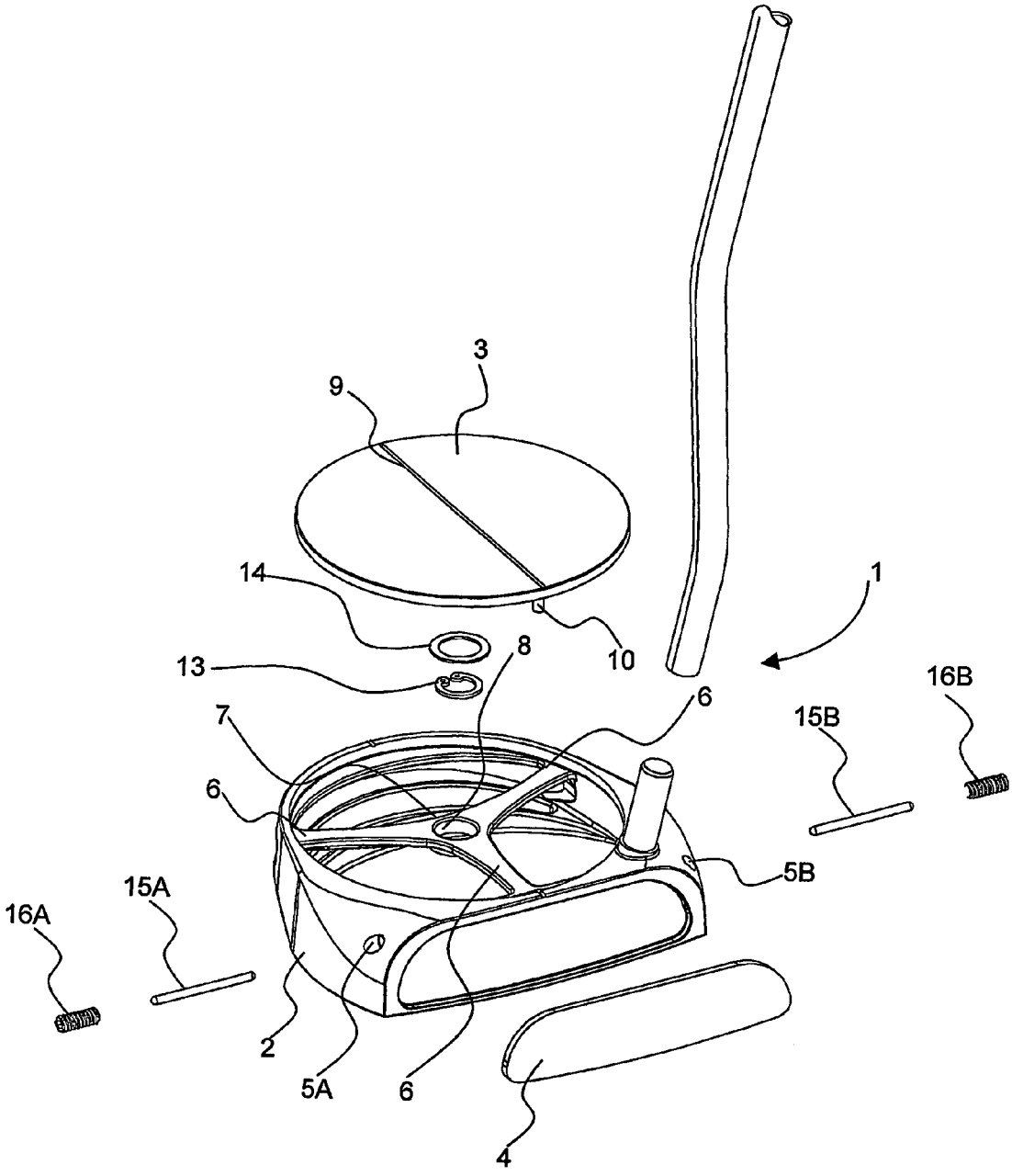
FIG. 2 shows an exploded front perspective view of the putter head shown in FIG. 1.
Figure 3:
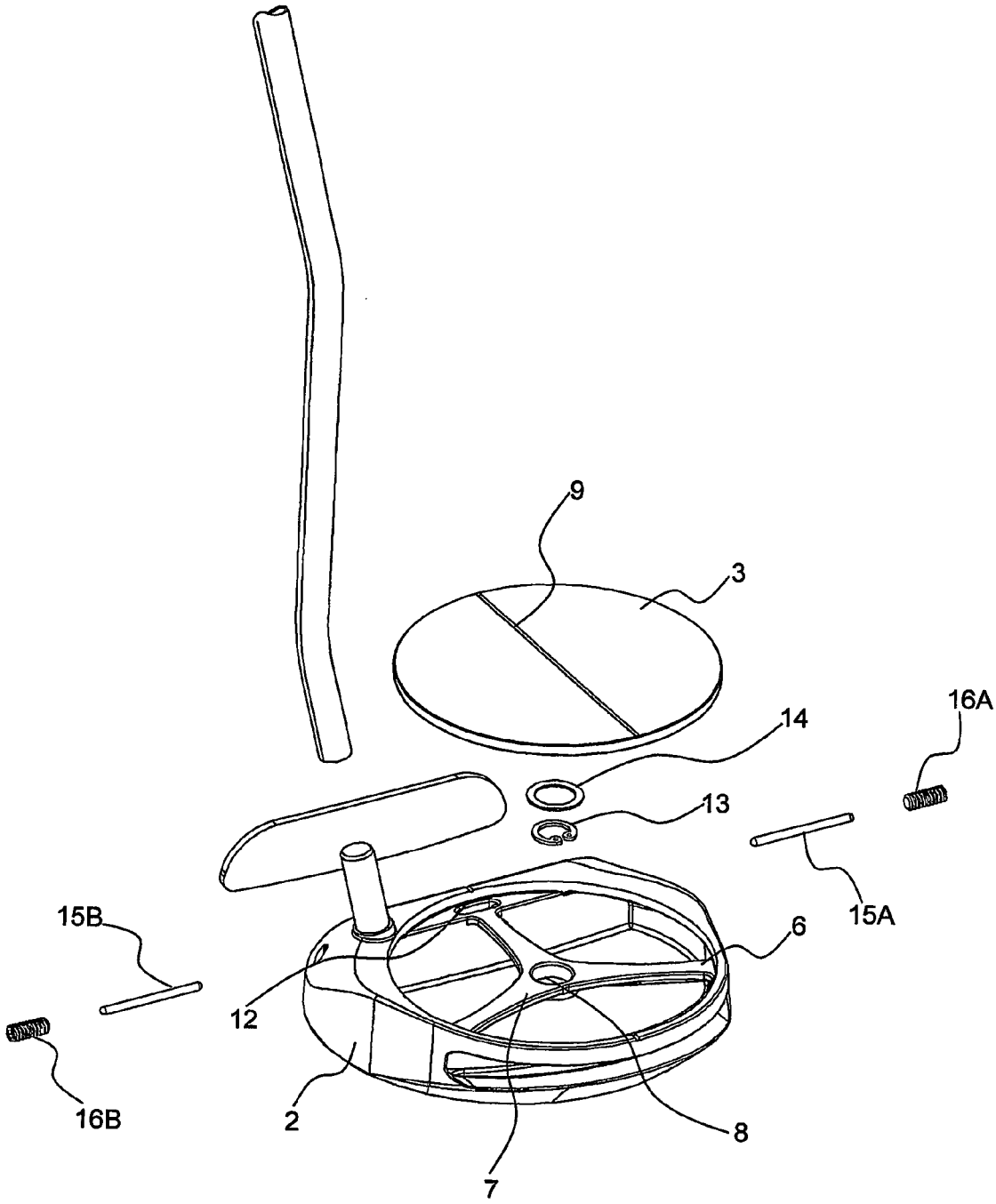
FIG. 3 shows an exploded rear perspective view of the putter head shown in FIG. 1.

FIG. 2 shows an exploded front view of putter head 1 with FIG. 3 showing an exploded back view of putter head 1. Body 2 is hollow and is formed from metal, graphite, wood or the like. Body 2 has a plurality of spokes 6 extending inwardly and meeting at a central hub 7. An aperture 8 is located at a central portion of hub 7. Additionally, body 2 further includes a guide slot 12 located adjacent putter face 4.

A guide protrusion 10 and a central shaft 11 (not shown in FIG. 2 or FIG. 3) extend downwardly from the rotatable disc 3. Central shaft 11 of rotatable disc 3 is located within central aperture 8. Rotatable disc 3 is securely fastened to body 2 by placing locking washer 13 on central shaft 11 below hub 7. Locking washer 13 is spring biased such that it is securely held on central shaft 11. Hence, locking washer 13 abuts the underside of hub 7 and securely holds rotatable disc 3 on hub 7. Additionally, a washer 14 is located on central shaft 11 between hub 7 and rotatable disc 3. Disc 3 is rotatable about a longitudinal axis of central shaft 11 when the shaft 11 is securely located within central aperture 8.

Putter head 1 further comprises push rods 15A and 15B and screws 16A and 16B the function of which will be described in more detail below.

Figure 4:
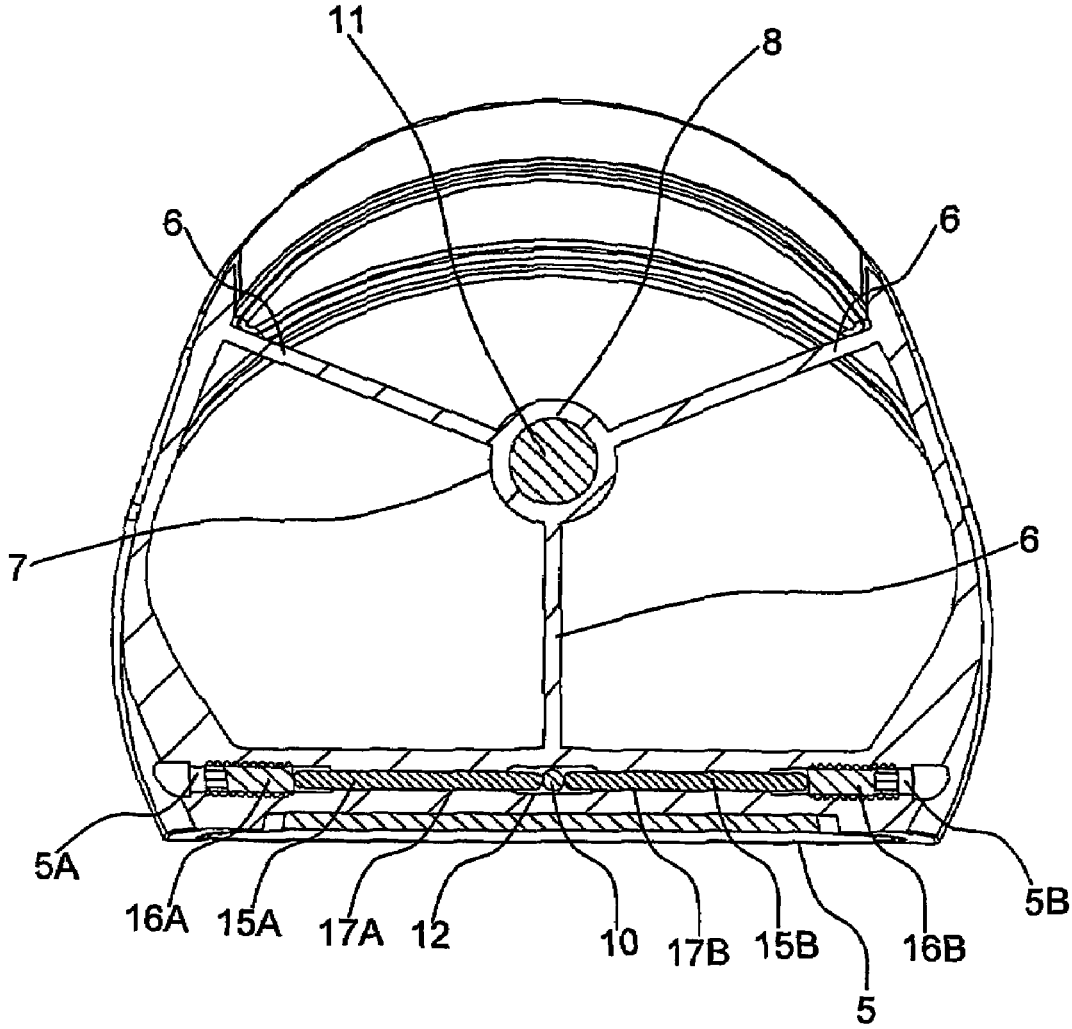
FIG. 4 shows a top sectional view of the putter had shown in FIG. 1.

FIG. 4 shows a top sectional view of putter head 1. As shown, central shaft 11 of rotatable disc 3 is located within central aperture 8. Additionally, guide protrusion 10 is located within guide slot 12. Adjustment screws 16A and 16B are located within threaded cavities 5A and 5B respectively.

Cavities 17A and 17B extend within body 2 from threaded cavities 5A and 5B respectively to guide slot 12. Push rods 15A and 15B are located within cavities 17A and 17B respectively. One end of each push rod 15A and 15B abuts their respective adjustment screw 16A and 16B and the opposing end of each push rod 15A and 15B abuts the guide protrusion 10 of rotatable disc 3.

In use, the rotatable disc 3 is selectively rotated about the longitudinal axis of central shaft 11 to correct the alignment error that is inherent to a players putting stroke as discussed above. A golf player makes putts with the rotatable disc being orientated in the primary position, as shown in FIG. 1. In this position linear marking 9 is aligned such that it is substantially perpendicular to putter face 4. As such, when a player executes a putting stroke, the linear marking 9 is aligned along the path of the players putting stroke and the putter face 4 is aligned substantially perpendicular to the path of the stroke. Hence, the angle between the putter face 4 and the linear marking 9 is substantially perpendicular.

As discussed, due to the inaccuracies of lining up a putt when the players head is at an angle, a right handed player will inevitably putt to the right of their intended target when the putter head 1 is in the primary position as shown in FIG. 1. However, the putter head 1 of the present invention allows a player to compensate for this inaccuracy by selectively rotating the rotatable disc 3. By rotating the disc 3 in a clockwise direction, as shown in FIG. 5, the angle between the linear marking 9 and the putter face 4 is adjusted such that it is no longer perpendicular.

In order to adjust the angle between the linear marking 9 and the putter face 4, the rotatable disc 3 is rotated about the central shaft 11 by tightening and loosening the adjustment screws 16A and 16B. To move the rotatable disc 3 to the position shown in FIG. 5, adjustment screw 16A is loosened such that it no longer abuts push rod 15A. Adjustment screw 16B is tightened such that it drives push rod 15B into guide protrusion 10 and operatively moves guide protrusion 10 along guide slot 12 in the direction of threaded cavity 5A. Guide protrusion 10 drives push rod 15A in the direction of threaded cavity 5A until push rod 15A once again abuts adjustment screw 16A. At this point movement stops and guide rods 15A and 15B once again abut their respective adjustment screws 16A and 16B and the guide protrusion 10.

This movement of guide protrusion 10 causes a clockwise rotation of the rotatable disc about the central shaft 11 such that the linear marking 9 is no longer perpendicular to the putter face 4. Hence, the angle between the putter face 4 and the linear marking 9 has been adjusted.

Figure 5:
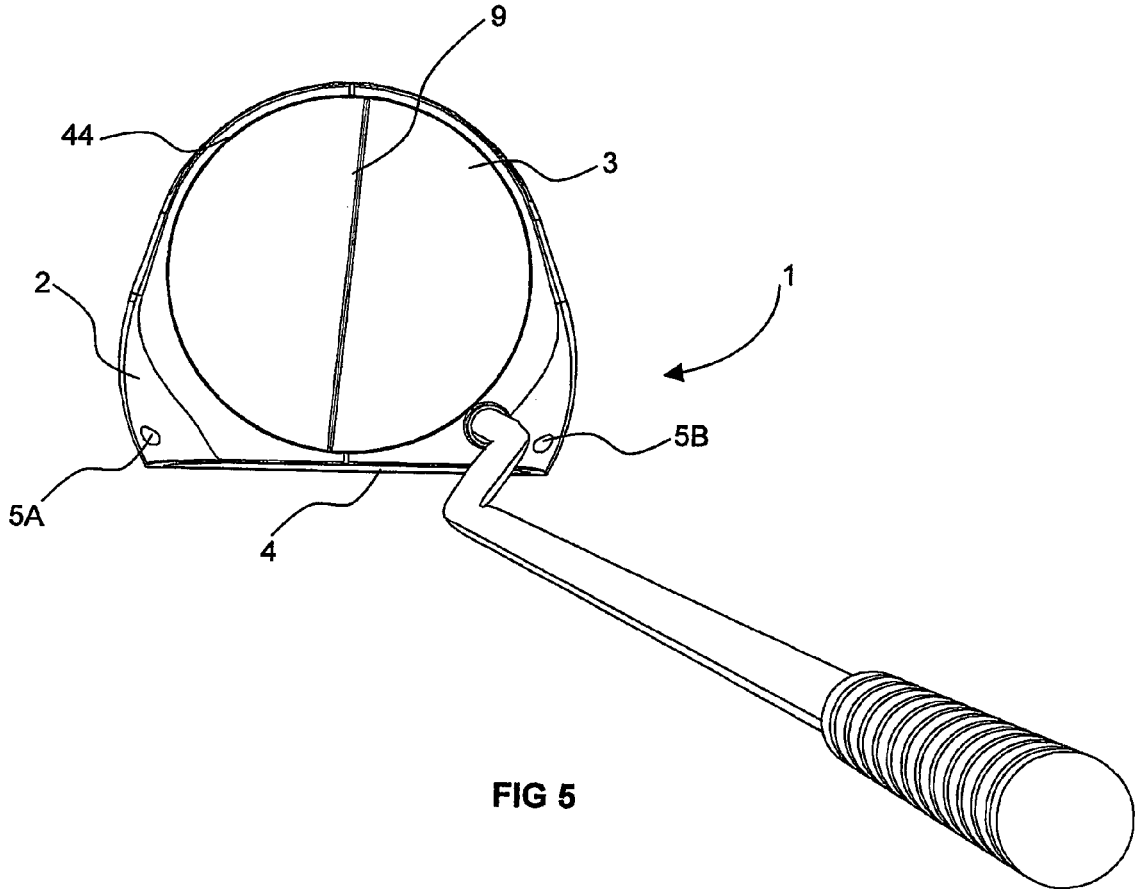
FIG. 5 shows a top perspective view of the putter head shown in FIG. 1 in a secondary position.

When the putter head 1 is in the position shown in FIG. 5 a player executes a stroke and aligns the linear marking 9 such that it is parallel to and along the line of the putting stroke. However, the putter face 5 is no longer perpendicular to the linear marking 9 and hence the putter face 5 is no longer perpendicular to the line of the intended stroke. This change in angle of the putter face 5 with respect to the linear marking 9, and hence the path of the putting stroke, accommodates the inaccuracies inherent in lining up putts and hence results in a more accurate stroke.

It will be appreciated that the rotatable disc 3 may be moveable through differing degrees and in both the clockwise and anti-clockwise direction. This allows a player to fine tune the amount of compensation necessary, i.e the amount of rotation the rotatable disc 3 is subjected to is determined by the player based on the amount of inherent inaccuracy that particular player has in lining up their stroke. Hence, the relative angle between the linear marking 9 and the putter face 4 is adjustable.

Figure 6:
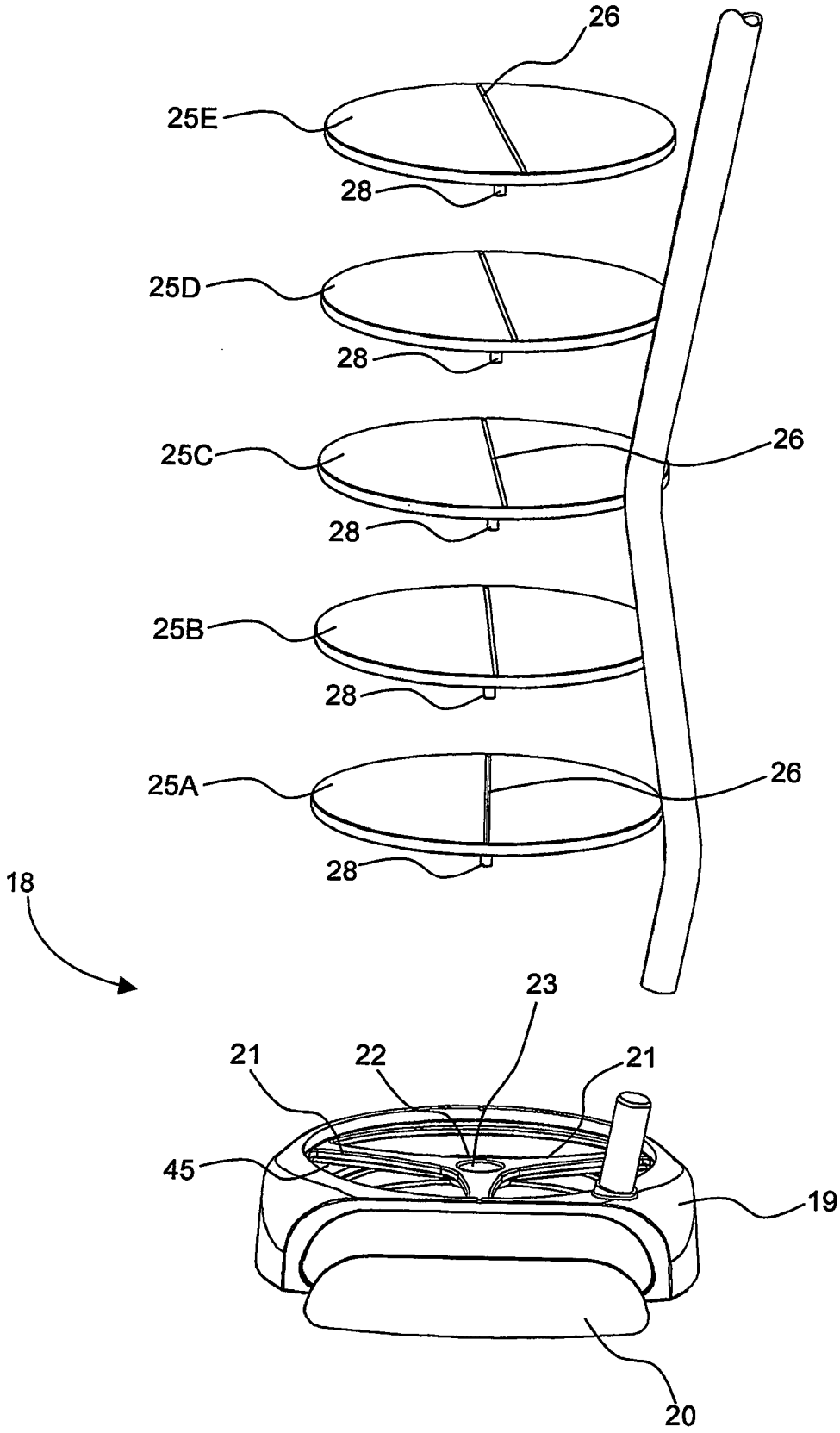
FIG. 6 shows an exploded perspective view of a putter head according to a second embodiment of the present invention.
Figure 7:
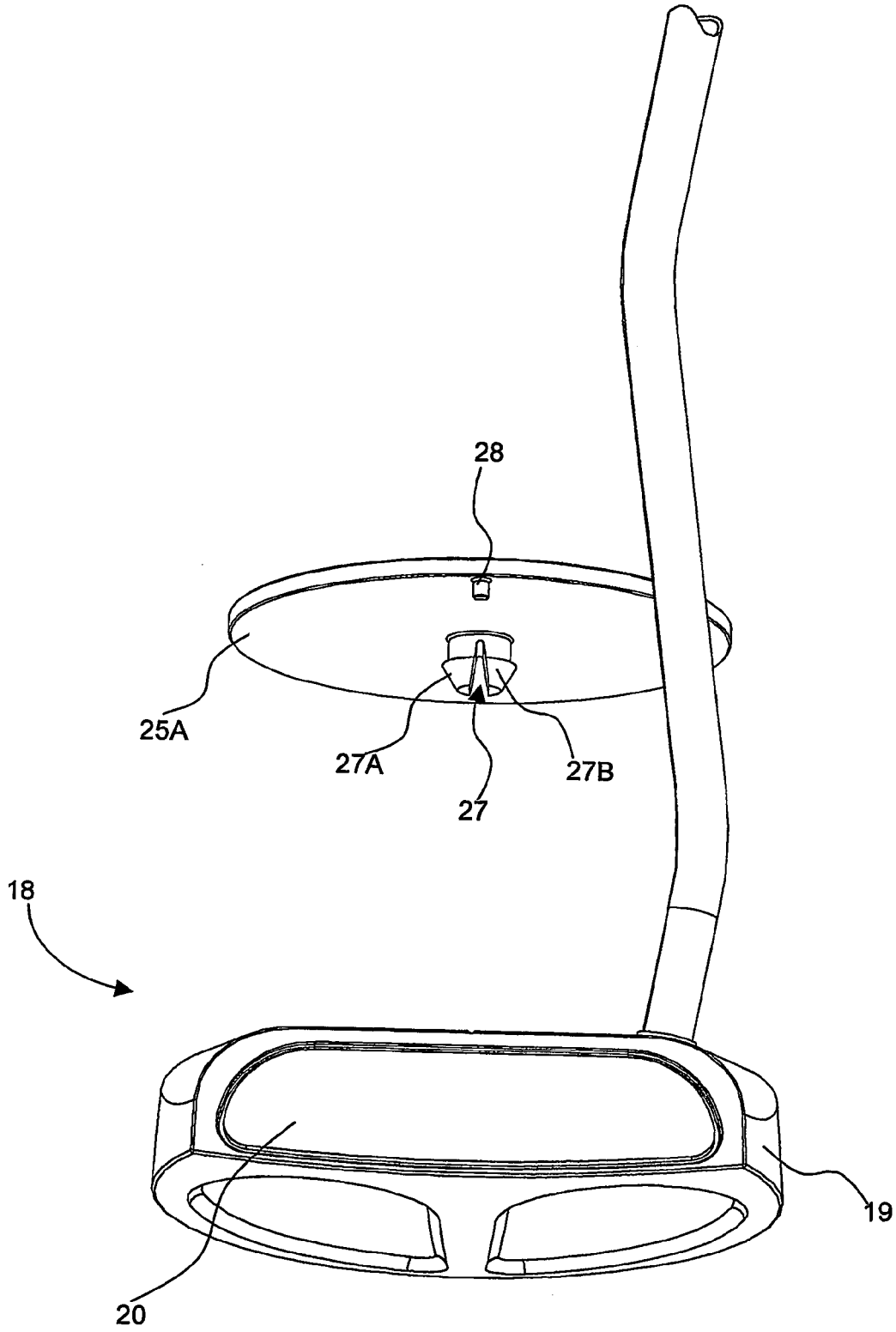
FIG. 7 shows a further exploded perspective view of the putter head shown in FIG. 6.
Figure 8:
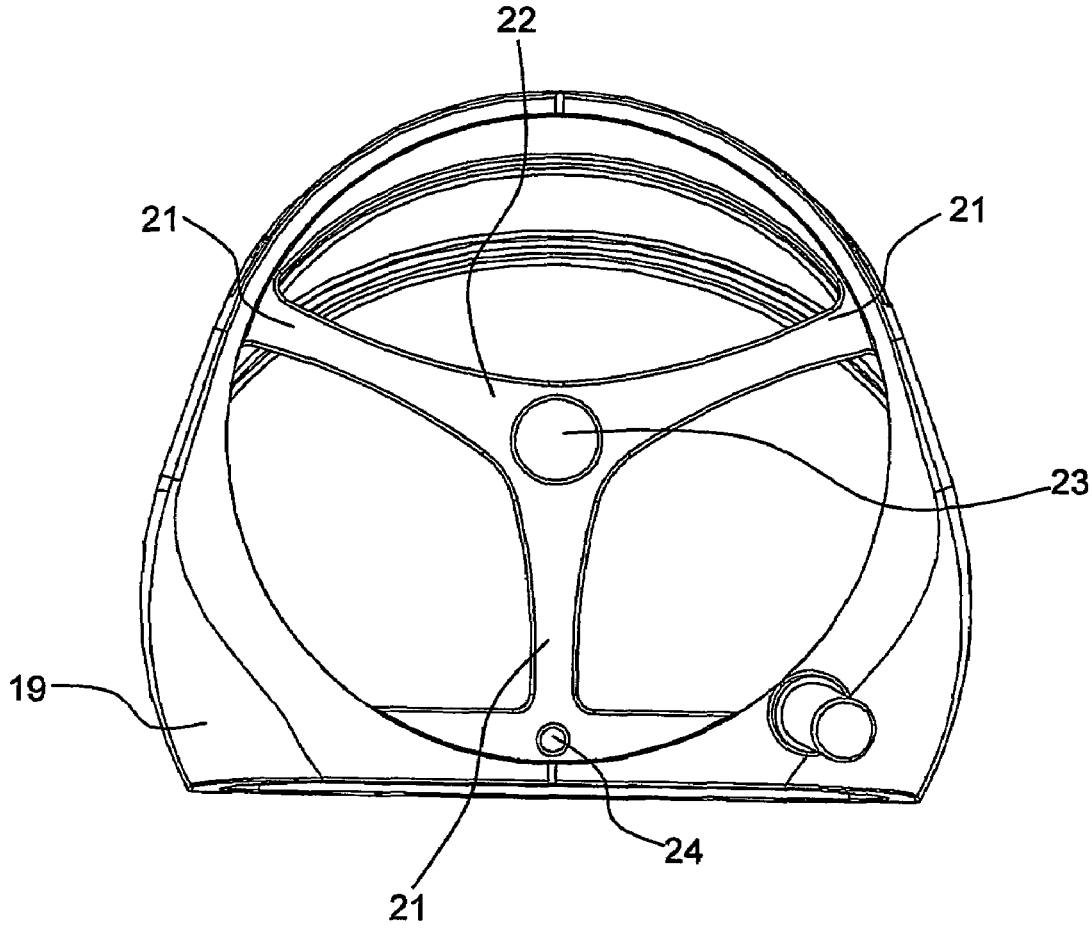
FIG. 8 shows a sectional top view of the putter head shown in FIG. 6.

FIG. 6, FIG. 7 and FIG. 8 show a putter head 18 according to a second embodiment of the present invention. Putter head 18 comprises a body 19, an upper surface 45 and a putter face 20. Similar to putter head 1, body 19 is hollow and has a plurality of spokes 21 extending inwardly and meeting at a central hub 22. A central aperture 23 is located at hub 22. Additionally, putter head 18 has an alignment aperture 24 located adjacent putter face 20.

Putter head 18 has associated with it a set of replaceable discs 25A-25E. A linear mark 26 is located on an upper face of each replaceable disc 25A-25E. Additionally, an alignment protrusion 28 extends downwardly from each replaceable disc 25A-25E. A pronged shaft 27 extends downwardly from a center of each replaceable disc 25A-25E. The pronged shaft 27 has two resilient angled arms 27A and 27B that are biased away from each other.

The operation of putter head 18 is similar to that of putter head 1 in that the angle of the linear mark 26 with respect to the putter face 20 is adjustable. However, putter head 26 has associated with it a series of replaceable discs 25A-25E wherein the orientation of the linear mark is different on each disc.

For example, in the primary position, replaceable disc 25A is fitted to the body 19 of putter head 18 by locating alignment protrusion 28 within alignment aperture 24 such that replaceable disc 25A forms the upper surface 45 of putter head 18. Additionally, pronged shaft 27 is located within central aperture 23 by way of an interference fit. Hence, the pronged shaft 27 releasably attaches the replaceable disc 25A to the putter head 18. When replaceable disc 25A is fitted to putter head 18 the linear marking 26 is aligned such that it is perpendicular to the putter face 20.

When a player needs to adjust the angle of the putter face 20 as it strikes a golf ball to accommodate for the inherent accuracies of lining up a putting stroke, replaceable disc 25A is replaced with one of a series of further replaceable discs 25B-25E. Replaceable disc 25A is removed from putter head 18 by levering the replaceable disc 25A away from the body 19. As pronged shaft 27 has two resilient angled arms 27A and 27B, the disc is easily removable.

As seen in FIG. 6, each of further replaceable discs 25B-25 E has the linear mark 26 orientated at varying angles to the alignment protrusion 28. Hence, when each further replaceable disc 25B-25E is fitted to body 19, the linear mark 26 is at an angle other than perpendicular to the putter face 20. As such, when any of further replaceable discs 25B to 25E are fitted to body 19, the putter face 20 strikes a golf ball at an angle other than perpendicular to the line of swing when the linear mark is parallel and aligned with the swing path of the puffer head 18. Hence, the linear mark 26 is moveable, by changing between the replaceable discs 25A-25E, such that the angle between the putter face 20 and the linear marking 26 may be adjusted.

It will be appreciated that there are a plurality of further replaceable discs of varying orientations of linear markings 26 to accommodate for the level of inherent inaccuracy a player has when judging the path of the putt and the direction in which the player predominantly misses a putt.

Figure 9:
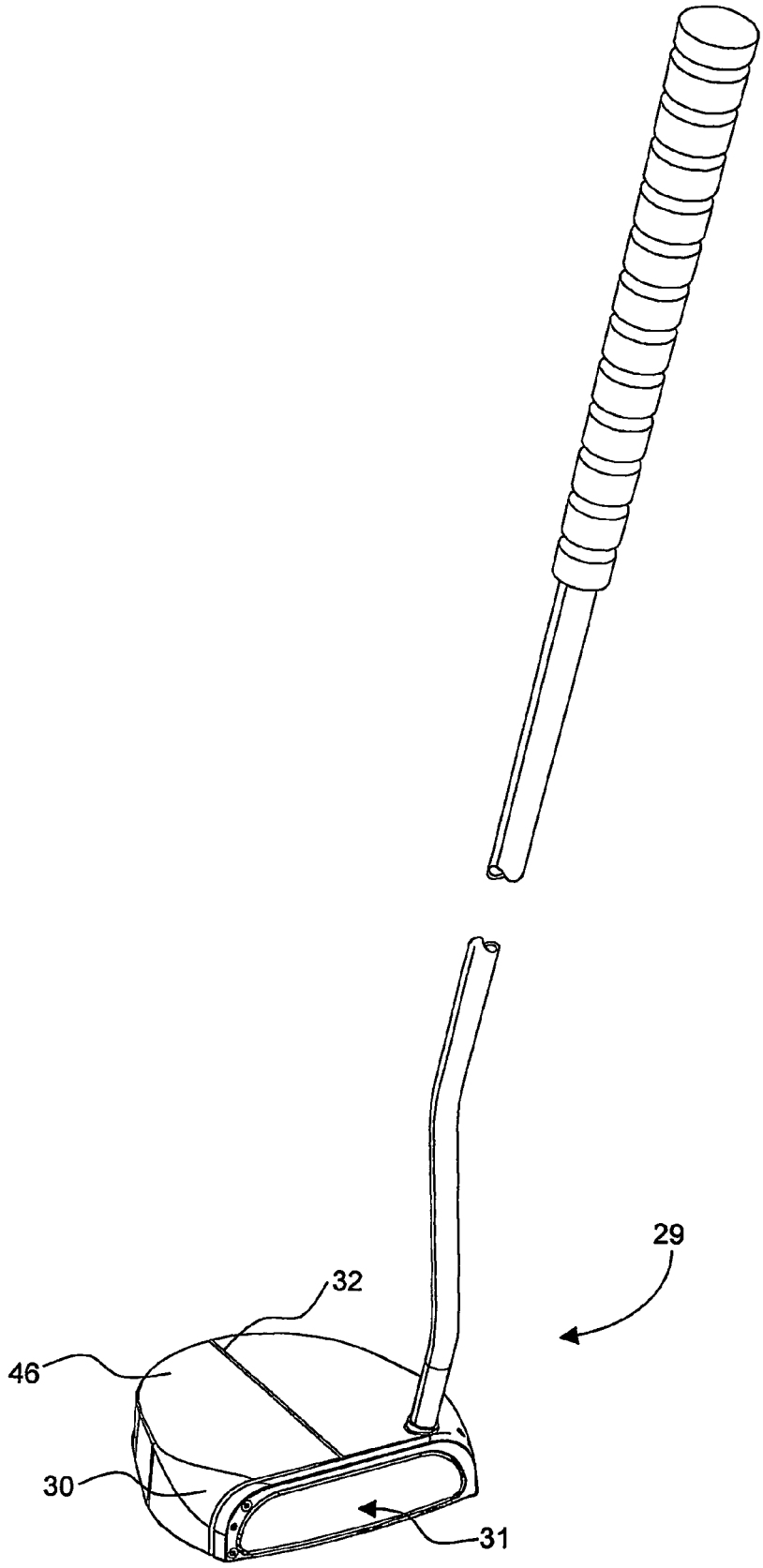
FIG. 9 shows a perspective view of a putter head according to a third aspect of the present invention.

FIG. 9 shows a perspective view of a putter head 29 according to a third embodiment of the present invention. Putter head 29 comprises a body 30, a hinged putter face 31 mounted to the putter head 29, and a linear marking 32 located on an upper surface 46 of putter head 29. Hinged putter face 31 comprises a front plate 31A (not shown in FIG. 9) and a back plate 31B. The front plate 31A is fastened to back plate 31B by means of glue, an interference fit, rivets or the like.

Figure 10:
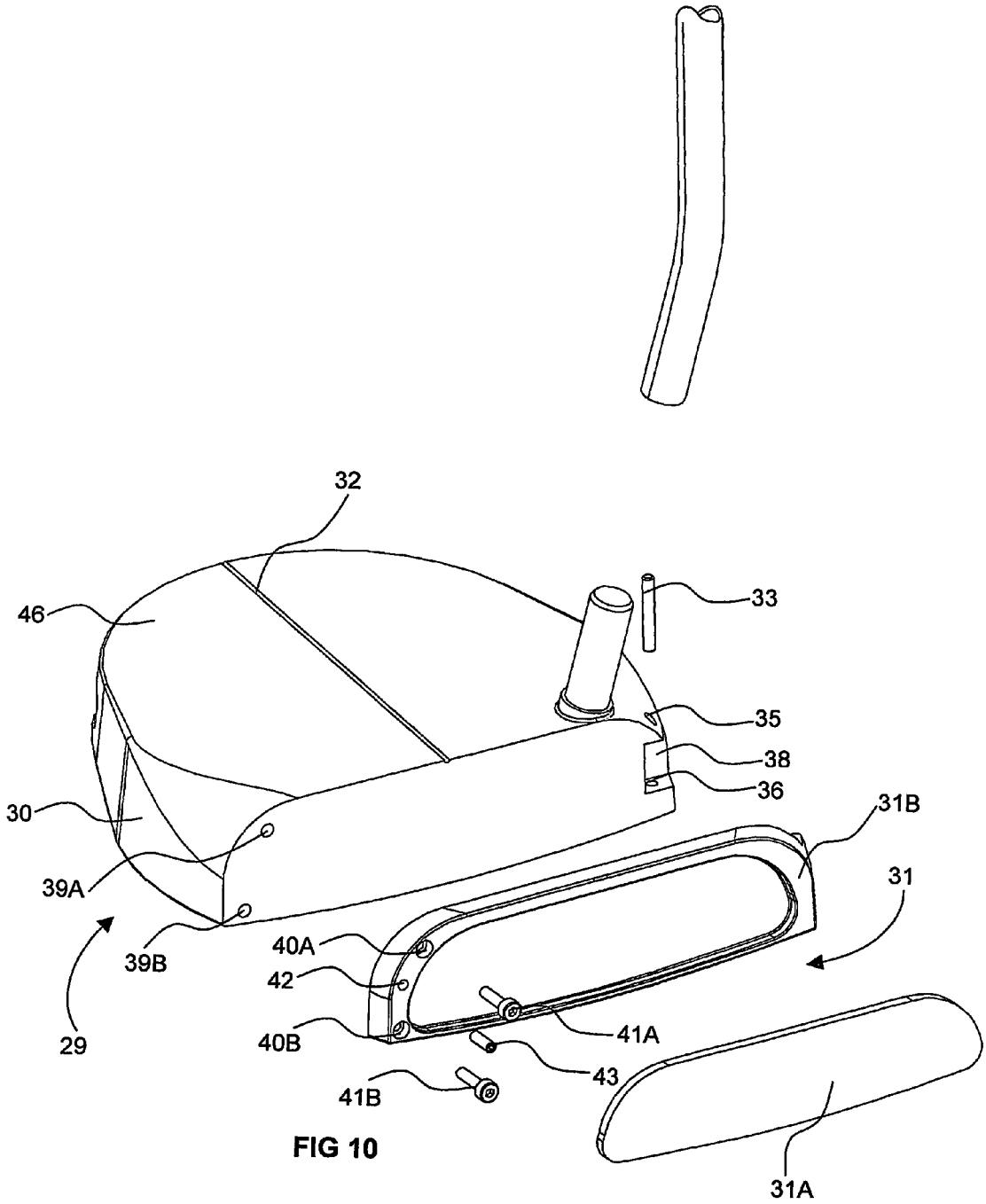
FIG. 10 shows an exploded perspective view of the putter head shown in FIG. 9.
Figure 11:
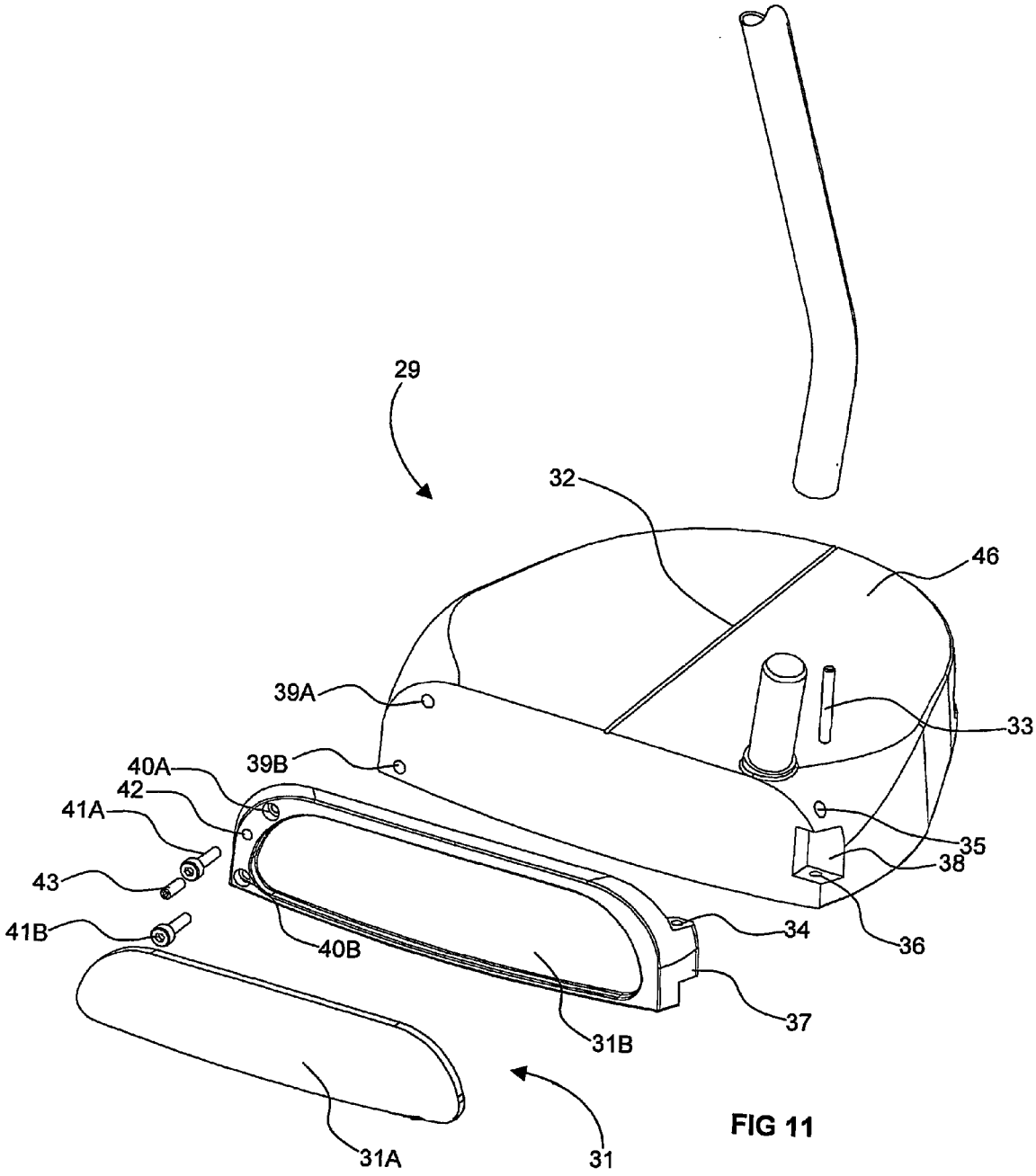
FIG. 11 shows a further exploded perspective view of the putter head shown in FIG. 9.

FIG. 10 and FIG. 11 show exploded perspective views of putter head 29. Putter head 29 further comprises a rod 33 located within an aperture 34 on hinged face 31. Rod 33 extends into an upper aperture 35 and a lower aperture 36 located on body 30 of putter head 29. Additionally, a protrusion 37 is located on hinged face 31 that is receivable within a recess 38 located on body 30 such that hinged face 31 is mounted to the putter head 29 and is pivotable about rod 33.

Two threaded apertures 39A and 39B are located on body 30 at an end distal to recess 38. Two holes 40A and 40B are located on hinged putter face 31 and are spaced such that they correspond with threaded apertures 39A and 39B located on body 30. Putter head 29 further comprises two screws 41A and 41B that are receivable through holes 40A and 40B and threaded apertures 39A and 39B. Putter head 29 also has an adjustment screw 43 that is receivable within a threaded aperture 42 located on hinged putter face 31.

Putter head 29 has a similar operation as previous embodiments described above in that the angle between the linear marking 32 and the face 31 is adjustable to compensate for the inaccuracies in a players aim when putting. However, as opposed to the two previous embodiments wherein the linear marking is moveable and the putter face remains fixed, putter head 29 has a hinged putter face 31 that is moveable such that the putter face changes orientation while the orientation of the linear marking 32 remains fixed.

Figure 12:
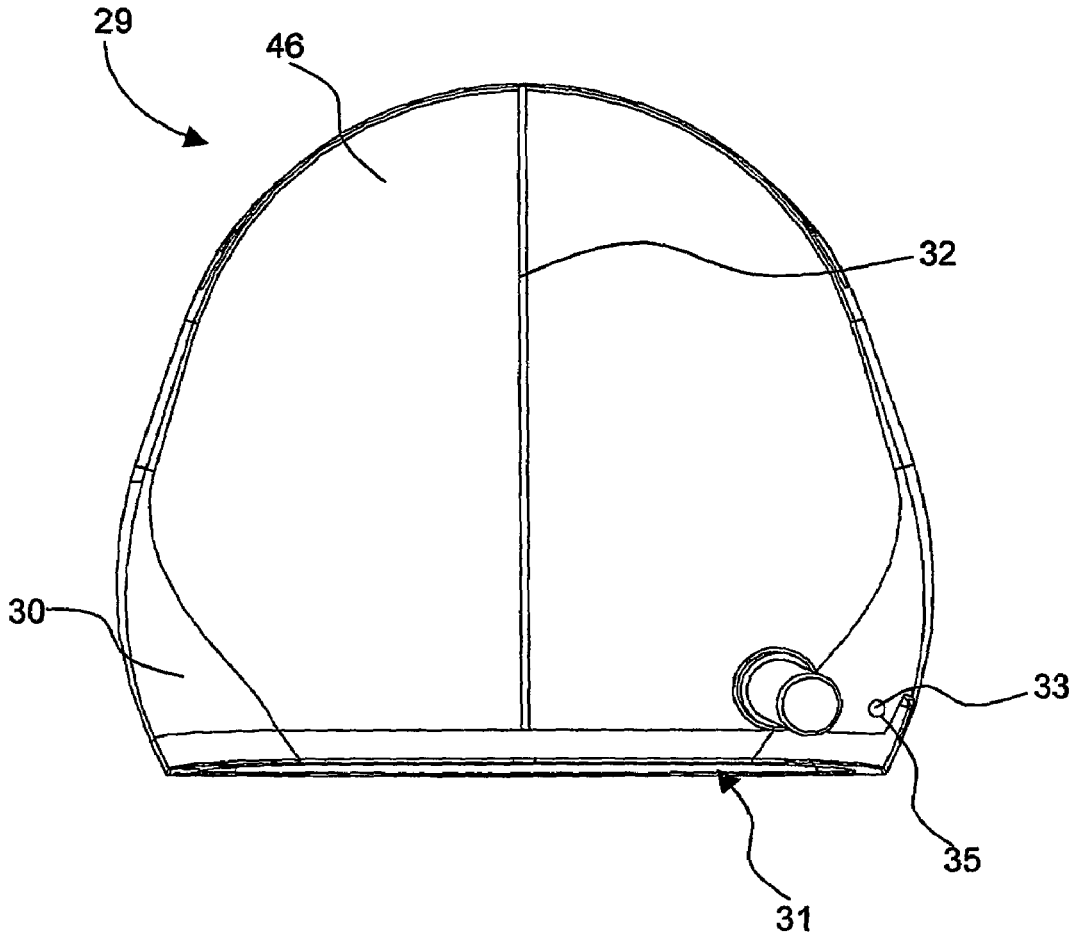
FIG. 12 shows a top view of the putter head shown in FIG. 9 in a primary position.
Figure 13:
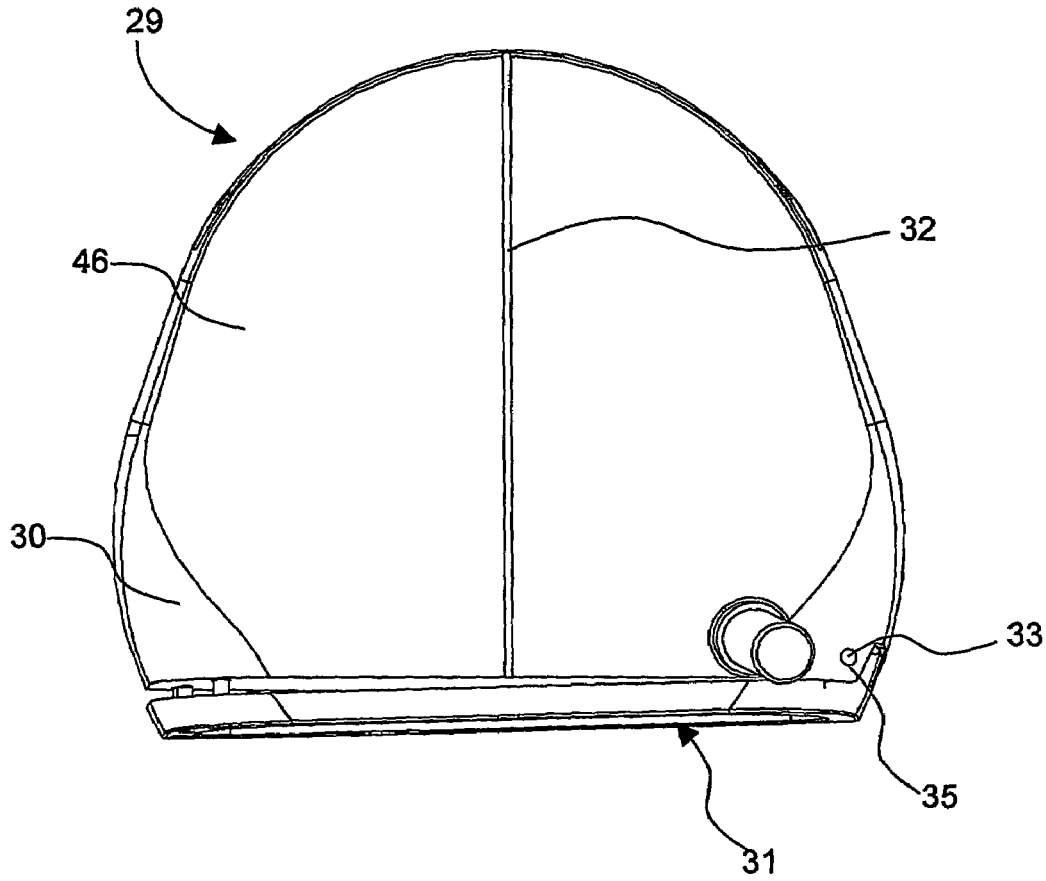
FIG. 13 shows a top view of the putter head shown in FIG. 9 in a secondary position.

FIG. 12 shows putter head 29 wherein the hinged putter face 31 is aligned perpendicular to the linear marking 32. FIG. 13 shows putter head 29 wherein the hinged putter face 31 has been pivoted around rod 33 such that the angle between the hinged putter face 31 and the linear marking 32 has been adjusted such that it is not perpendicular.

Hinged putter face 31 is pivoted about rod 33 by unscrewing both of screws 41A and 41B such that the hinged putter face 31 can be rotated about rod 33 away from body 30. Adjustment screw 43 is then unscrewed such that it drives hinged putter face 31 about rod 33. As threaded aperture 42 is threaded, adjustment screw 43 prevents hinged putter face 31 from pivoting back towards body 30. Additionally, the threads in threaded apertures 39A and 39B allow screws 41A and 41B to prevent hinged putter face 31 from moving away from body 30.

The putter head of the present invention offers a clear and significant advantage for golfers. In particular, the putter head allows golfers to compensate for inherent inaccuracies in lining up a putt by providing an adjustment mechanism that alters the angle of the putter face with respect to a linear line marking wherein the linear line marking indicates the swing path of the putt. Hence, the puffer head of the present invention will result in a higher proportion of a players putts reaching their intended target.

The putter head of the present invention has been described with reference to a putter for use by a right-handed player. It will be appreciated that putter heads for use by left-handed players fall within the scope of this invention.

Throughout the specification the aim has been to describe the invention without limiting the invention to any one embodiment or specific collection of features. Persons skilled in the relevant art may realize variations from the specific embodiments that will nonetheless fall within the scope of the invention.

It will be appreciated that various other changes and modifications may be made to the embodiment described without departing from the spirit and scope of the invention.

The invention claimed is:

1. The putter head comprising:

a putter face; and a linear marking inscribed upon a rotatable disc, said rotatable disc forming an upper surface formed from a rotatable disc, said rotatable disc comprising a central shaft and a guide protrusion, said rotatable disc being moveable about a longitudinal axis of said central shaft under a force applied to said guide protrusion of said putter head, said linear marking orientated at an angle to said putter face wherein said angle is adjustable by rotation of said rotatable disc and comprising at least one adjustment screw located in a cavity in said putter head, said at least one adjustment screw being in operative contact with said guide protrusion and operable by a user to provide said force to said guide protrusion.

* * * * *